US009972256B2

(12) United States Patent
Kang et al.

(10) Patent No.: US 9,972,256 B2
(45) Date of Patent: May 15, 2018

(54) LCD PANEL AND DRIVING METHOD THEREOF

(71) Applicant: Shenzhen China Star Optoelectronics Technology Co., Ltd., Shenzhen, Guangdong (CN)

(72) Inventors: Chih-tsung Kang, Guangdong (CN); Lixuan Chen, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 313 days.

(21) Appl. No.: 14/779,679

(22) PCT Filed: May 29, 2015

(86) PCT No.: PCT/CN2015/080195
§ 371 (c)(1),
(2) Date: Sep. 24, 2015

(87) PCT Pub. No.: WO2016/183864
PCT Pub. Date: Nov. 24, 2016

(65) Prior Publication Data

US 2017/0098419 A1 Apr. 6, 2017

(30) Foreign Application Priority Data

May 21, 2015 (CN) ..... 2015 1 0264226

(51) Int. Cl.
*G09G 3/36* (2006.01)
*G09G 3/20* (2006.01)

(52) U.S. Cl.
CPC ..... *G09G 3/3607* (2013.01); *G09G 3/2003* (2013.01); *G09G 3/2074* (2013.01);
(Continued)

(58) Field of Classification Search
CPC ... G09G 2300/0443; G09G 2320/0242; G09G 2320/027; G09G 3/2003; G09G 3/2074; G09G 3/3607; G09G 3/3688
See application file for complete search history.

(56) References Cited

U.S. PATENT DOCUMENTS

2008/0036718 A1* 2/2008 Lee ..... G09G 3/3607 345/88
2010/0053052 A1* 3/2010 Shimoshikiryoh .. G09G 3/3607 345/89

(Continued)

FOREIGN PATENT DOCUMENTS

CN 101009083 A 8/2007
CN 102248222 A 11/2011
CN 104299592 A 1/2015

*Primary Examiner* — Afroza Chowdhury
(74) *Attorney, Agent, or Firm* — Andrew C. Cheng

(57) ABSTRACT

A method for driving a liquid crystal panel comprises providing a liquid crystal panel with a plurality of pixel units in a matrix with M rows and N columns, wherein each of the pixel unit has at least a blue sub-pixel, dividing the liquid crystal panel into multiple display units, wherein each display unit comprises two of the pixel units, providing a gray level value, B, to the blue sub-pixels of each of the display units with a higher gray level value, BH, and a lower gray level value, BL, to the blue sub-pixels respectively, wherein the combination of BH and BL results the blue sub-pixels in the display unit to approach a predetermined Gamma Curve, and γ=1.8~2.4 at a perspective viewing angle. This invention also discloses a liquid display panel comprising the driving method mentioned above.

10 Claims, 4 Drawing Sheets

(52) U.S. Cl.
CPC ... *G09G 3/3688* (2013.01); *G09G 2300/0443* (2013.01); *G09G 2320/0242* (2013.01); *G09G 2320/0276* (2013.01)

(56) References Cited

U.S. PATENT DOCUMENTS

| | | | | |
|---|---|---|---|---|
| 2010/0207969 | A1* | 8/2010 | Ueki | G09G 3/3607 345/694 |
| 2012/0268357 | A1* | 10/2012 | Shih | G09G 3/3607 345/88 |
| 2013/0194170 | A1* | 8/2013 | Saitoh | G09G 3/20 345/103 |
| 2015/0325165 | A1* | 11/2015 | Mori | G09G 3/2025 345/698 |
| 2016/0335944 | A1* | 11/2016 | Kang | G09G 3/2074 |
| 2016/0335945 | A1* | 11/2016 | Kang | G09G 3/2051 |

* cited by examiner

LCD PANEL AND DRIVING METHOD THEREOF

BACKGROUND OF THE INVENTION

1. Field of the Invention

This invention is related the liquid crystal display. More particularly, it's related to a liquid crystal panel and driving method thereof.

2. The Related Arts

LCD (liquid Crystal Display) is a flat and thin display device. It is composed of a certain quantity of color, black and white pixels disposed in front of a light source or a reflector. LCD is currently widely accepted and becomes the mainstream display device due to its low power consumption, high display quality, compact size and light weight. It's widely adopted in various electronic device, such as computing devices, mobile phones, or digit photo frames. The wide viewing angle technology is one of the hot spots of the LCD industry. However, the color shift issue inevitably occurs while viewing at a large angle.

To solve this color shift issue, a 2D1G technology is adapted. 2D1G means a technology to divide each pixel into a main pixel and a sub pixel. The main pixel and the sub pixel have different areas. The main pixel and sub pixel of each pixel are connected to the same gate line and different data lines respectively. By inputting different signal (gray level value) via the different data lines to the main pixel and the sub pixel, it generates different display brightness and brightness at a large angel to lower the color shift issues while viewing at a large angle. However, the data lines are doubled after dividing each pixel into a main pixel and a sub pixel. The aperture ratio would be reduced to affect the transmittance, and the display quality would be lowered as well.

SUMMARY OF THE INVENTION

In view of this, an object of the invention is to provide a liquid crystal panel and a driving method by changing the driving method of the liquid crystal panel, simulating 2D1G display panel behavior in the conventional RGB three pixels in the liquid crystal panel to reduce the side view or perspective color shift problems arising.

To achieve the above object, the present invention employs the following technical solutions:

A method for driving a liquid crystal panel comprises providing a liquid crystal panel with a plurality of pixel units in a matrix with M rows and N columns, wherein each of the pixel unit has at least a blue sub-pixel, dividing the liquid crystal panel into multiple display units, wherein each display unit comprises two of the pixel units, providing a gray level value, B, to the blue sub-pixels of each of the display units with a higher gray level value, BH, and a lower gray level value, BL, to the blue sub-pixels respectively, wherein the combination of BH and BL results the blue sub-pixels in the display unit to approach a predetermined Gamma Curve, and $\gamma$=1.8~2.4 at a perspective viewing angle.

Preferably, the pixel units in the display unit are adjacent to each other.

Preferably, the pixel units in the display unit are located in the same column row and in different columns which are spaced apart by another.

Preferably, the pixel units in the display unit are located in the same column row and in different columns which are adjacent to each other and the pixel unit in the same row and the column which is adjacent receive higher BH than the other pixel unit in the display unit.

Preferably, the pixel units in the display unit are located in the same column and in different rows which are adjacent to each other and the pixel unit in the same column and the row which is adjacent to receive higher BH than the other pixel unit in the display unit.

Preferably, the step of providing a gray level value, B, to the blue sub-pixels of each of the display units with a higher gray level value, BH, and a lower gray level value, BL further comprises:

S101, acquiring a relationship between the gray level value $B_0$ of the blue sub-pixel at a front viewing angle $\alpha$ and the actual brightness $Lv\alpha B_0$ in the curve $B_0$–$Lv\alpha B_0$;

S102, acquiring a relationship between the gray level value $B_0$ of the blue sub-pixel at a perspective viewing angle $\beta$ and the actual brightness $Lv\beta B_0$ in the curve $B_0$–$Lv\beta B_0$;

S103, acquiring the relation curve B–$Lv\alpha B$ and B–$Lv\beta B$ under the gray level value B and a theoretical brightness LvB at the front viewing angle $\alpha$ and the perspective viewing angle $\beta$ in accordance with the equation $$\left(\frac{B}{255}\right)^{\gamma} = \frac{Lv\alpha B}{Lv\alpha(255)} \text{ and } \left(\frac{B}{255}\right)^{\gamma} = \frac{Lv\beta B}{Lv\beta(255)},$$

wherein the $Lv\alpha(255)$ and $Lv\beta(255)$ are looked up from the relation curves $B_0$–$Lv\alpha B_0$ and $B_0$–$Lv\beta B_0$.

S104, BH and BL of the gray level value B to the blue sub pixels in the display unit are in accordance with the following equations:

$$\Delta 1 = Lv\alpha B + Lv\alpha B - Lv\alpha(BH) - Lv\alpha(BL);$$

$$\Delta 2 = Lv\beta B + Lv\beta B - Lv\beta(BH) - Lv\beta(BL);$$

$$y = \Delta 1^2 + \Delta 2^2;$$

Wherein y is the minimum, $Lv\alpha B$ and $Lv\beta B$ are looked up from curves B–$Lv\alpha B$ and B–$Lv\beta B$, $Lv\alpha(BH)$ and $Lv\alpha(BL)$ are looked up from $B_0$–$Lv\alpha B_0$, and $Lv\beta(BH)$ and $Lv\beta(BL)$ are looked up from $B_0$–$Lv\beta B_0$; and

S105, resetting a look up table (LUT) for each of the gray level value B of the blue sub-pixels in the display unit to acquire a combination of BH and BL in accordance with S104.

Preferably, the front viewing angle $\alpha$ is 0° and the perspective viewing angle $\beta$ is 30~80°.

Preferably, the front viewing angle $\alpha$ is 0° and the perspective viewing angle $\beta$ is 60°.

Preferably, the pixel unit further comprises a red sub-pixel and a green-sub pixel, and the data signals of the red sub-pixel and the green sub-pixel is constant while resetting the data line signal of the blue sub-pixel.

Preferably, the predetermined Gamma curve is $\gamma$=2.2.

This invention also discloses a liquid display panel comprising a gate controller, a source controller, and an active area having a plurality of pixel units in a matrix with M rows and N columns and at least one blue sub-pixel in each pixel unit, wherein the driving method of the liquid crystal display is followed by the method mentioned above.

The beneficial effects:

The present invention provides a liquid crystal panel and a driving method, the traditional three-pixel LCD panel RGB analog 2D1G panel display by changing the driving method to reduce color shift problem generated when the side view or perspective, without comparing small aperture ratio LCD panel was not to protect the quality of the liquid crystal panel.

BRIEF DESCRIPTION OF THE DRAWINGS

The detailed descriptions accompanying drawings and the embodiment of the present invention are as follows, which allows the technical solutions and other beneficial effects of the present invention more obvious.

DETAILED DESCRIPTION OF THE PREFERRED EMBODIMENTS

In order to more clearly describe the technical solutions and the effects in the present invention, the preferred embodiment of the present invention accompanying drawings are described in detail as follows.

Figure 1:
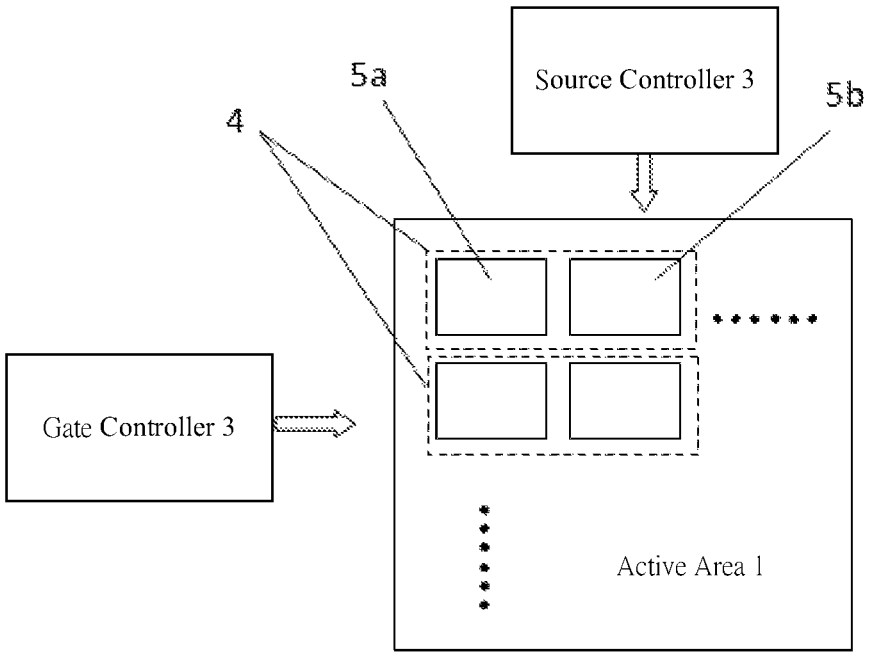
FIG. 1 is a schematic structural view of the embodiment of a liquid crystal panel in the present invention.
Figure 2:
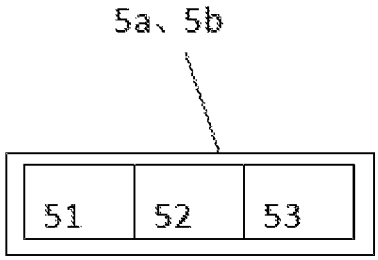
FIG. 2 is a schematic structural view of the embodiment of a pixel unit in the present invention.

With reference FIG. 1 and FIG. 2, the conventional liquid crystal panel comprises an active area 1 having a plurality of pixel units 5*a*/5*b* in a matrix with M rows and N columns, a gate controller 2, and a source controller 3. The gate controller 2 provides a scan signal to the pixel unit 5*a*/5*b* via a plurality of data lines and each of the pixel units 5*a*/5*b* comprises a red sub-pixel 51, a green sub-pixel 52, and a blue sub-pixel 53.

The present embodiment is achieved by changing the method for driving a liquid crystal panel, analog 2D1G panel display in three RGB pixels as a conventional liquid crystal panel, to reduce color shift problems when a side view or perspective.

Figure 3:
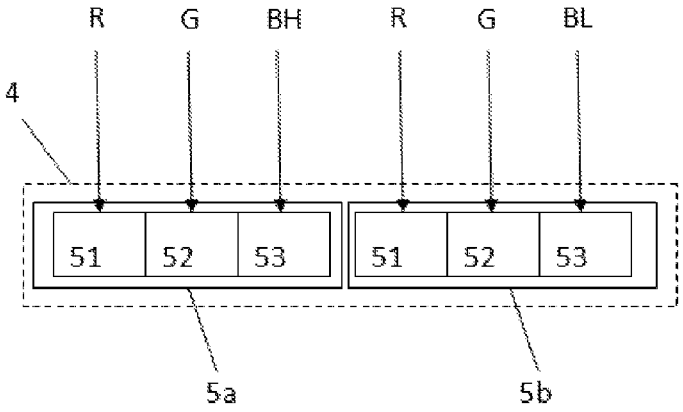
FIG. 3 is an exemplary illustration of a driving method of a data signal to the display unit in one embodiment of the present invention FIG. 4 provides an actual brightness curve of the blue sub-pixel at a front viewing angle and a perspective viewing angle of the liquid crystal panel in one embodiment of the invention.

To achieve this, with reference to FIG. 1 and FIG. 3, the active area 1 of the liquid crystal panel is divided into a plurality of display units 4. Each display unit 4 comprises a first pixel unit 5*a* and a second pixel unit 5*b*. While driving the liquid crystal panel, for the gray level value B of the blue sub-pixels 53 which is required by the display unit, this embodiment provides a higher gray level value BH to the blue sub-pixel of the first pixel unit 5*a*, and a lower gray level value BL to the blue sub-pixel of the second pixel unit 5*b*. The combination of BL and BH makes the brightness curve of the sub-pixels 53 of the display unit approach a predetermined Gamma (γ) curve at a perspective viewing angle. The Gamma (γ) curve is determined upon the actual requirement of the liquid display panel. In an embodiment, γ could be 1.8~2.4. FIG. 3 is an exemplary illustration of a driving method of a data signal to the display unit 4. With reference to FIG. 3, in the two pixel units 5*a*/5*b* of the display unit 4, the data signals of R and G to the red sub-pixel 51 and the green sub-pixel 52 are kept consistently while resetting the data signal BH and BL of the blue sub-pixels 53.

wherein the front viewing angle α is 0° and the perspective viewing angle β is 30~80°.

With reference to FIGS. 1-3, the step of providing a gray level value, B, to the blue sub-pixels of each of the display units with a higher gray level value, BH, and a lower gray level value, BL further comprising:

S101, acquiring a relationship between the gray level value $B_0$ of the blue sub-pixel at a front viewing angle α and the actual brightness $Lv\alpha B_0$ in the curve $B_0$–$Lv\alpha B_0$;

S102, acquiring a relationship between the gray level value $B_0$ of the blue sub-pixel at a perspective viewing angle β and the actual brightness $Lv\beta B_0$ in the curve $B_0$–$Lv\beta B_0$;

S103, calculate to obtain the gray level B of the blue sub-pixel 53 at the front viewing angle α and the perspective viewing angle β, B–Lv0B and B–Lv60B, respectively in the LvB relationship curve B–LvαB and B–LvβB in accordance with the equations:

$$\left(\frac{B}{255}\right)^{2.2} = \frac{Lv0B}{Lv0(255)} \text{ and } \left(\frac{B}{255}\right)^{2.2} = \frac{Lv60B}{Lv60(255)}.$$

Lvα(255) and Lvβ(255) are respectively looked up from the relation curve $B_0$–$Lv\alpha B_0$ and $B_0$–$Lv\beta B_0$.

S104, while the gray level value B of the blue sub-pixel units is required by the display unit 4, the gray level value BH in the blue sub-pixel 53 of the first pixel unit 5*a* and the gray level value BL in the blue sub-pixel 53 of the second pixel unit 5*b* would satisfy the following equations:

$$\Delta 1 = Lv\alpha B + Lv\alpha B - Lv\alpha(BH) - Lv\alpha(BL);$$

$$\Delta 2 = Lv\beta B + Lv\beta B - Lv\beta(BH) - Lv\beta(BL);$$

$$y = \Delta 1^2 + \Delta 2^2;$$

wherein y is the minimum, LvαB and LvβB are looked up from curves B–LvαB and B–LvβB, Lvα(BH) and Lvα(BL) are looked up from $B_0$–$Lv\alpha B_0$, and Lvβ(BH) and Lvβ(BL) are looked up from $B_0$–$Lv\beta B_0$.

S105, resetting a look up table (LUT) for each of the gray level value B of the blue sub-pixels in the display unit to acquire a combination of BH and BL in accordance with S104.

The following embodiment describes the gray level value B and combination of divided gray level value BH and BL at the γ=2.2 in the Gamma curve, the front viewing angle α=0 and the perspective angle β=60°.

Figure 4:
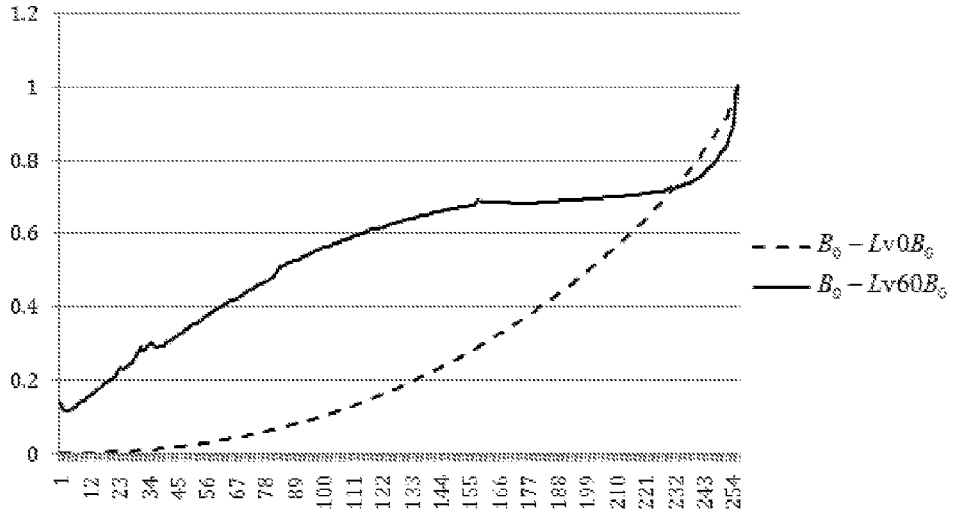

First, acquire the gray level value $B_0$ of the blue sub-pixel 53 at the front viewing angle α=0° and the actual brightness $Lv0B_0$ in accordance the relationship curve $B_0$–$Lv60B_0$ at the perspective viewing angle δ=60°. Please refer to FIG. 4. FIG. 4 illustrates a relationship curve, wherein the gray level of the liquid crystal level comprises 256 gray levels, from 0 to 255.

Subsequently, calculate the gray level B of the blue sub-pixel 53 at the front viewing angle α=0° and the perspective viewing angle β=60°, B–Lv0B and B–Lv60B, respectively in the LvB relationship curve B–Lv0B and B–Lv60B in accordance with the equations:

$$\left(\frac{B}{255}\right)^{2.2} = \frac{Lv0B}{Lv0(255)} \text{ and } \left(\frac{B}{255}\right)^{2.2} = \frac{Lv60B}{Lv60(255)}.$$

In the aforementioned equations, acquire the brightness at $B_0$=255 in the relationship curve $B_0$–$Lv0B_0$ at the front viewing angle α=0° and the brightness at $B_0$=255 in the relationship curve $B_0$–$Lv60B_0$ at the front viewing angle β=60°.

Moreover, if the display unit 4 requires a gray level value B in the blue sub-pixel 54 (the original gray level inputs to the blue sub-pixels in the first pixel unit 5*a* and the second pixel unit 5*b* are both B), instead of B, the input of the gray level value to the blue sub-pixel 53 in the first pixel unit 5*a* is BH, and the input of the gray level value to the blue sub-pixel 53 in the second pixel unit 5*b* is BL in accordance with the following equations:

$$\Delta 1 = Lv0B + Lv0B - Lv0(BH) - Lv0(BL);$$

$$\Delta 2 = Lv60B + Lv60B - Lv60(BH) - Lv60(BL);$$

$$y = \Delta 1^2 + \Delta 2^2;$$

While the gray level value B of the blue sub-pixel is confirmed, look up the value Lv0B and Lv60B in the theoretical brightness curves, B–Lv0B and B–Lv60B. Meanwhile, look up Lv0(BH) and Lv0(BL) in the actual brightness curve $B_0$–$Lv0B_0$, and Lv60(BH) and Lv60(BL) in the actual brightness curve $B_0$–$Lv60B_0$ to make y being minimum for obtaining the corresponding gray level value BH and BL.

At last, obtain a corresponding combination of BH and BL according to the aforementioned calculation for each gray level value B of the blue sub-pixel 53 is required by the display unit, and reset the look up table of the blue sub-pixel 53 in the liquid crystal panel. During driving the liquid crystal panel, if the gray level value B of the blue sub-pixels 53 is required by the display unit 53 when display a first picture, obtain the gray level value to the blue sub-pixel 53 in the first pixel unit 5*a* is BH, and the gray level value to the blue sub-pixel 53 in the second pixel unit 5*b* is BL.

The layout of the first pixel unit 5*a* and the second pixel unit 5*b* in the display unit 4 could be in the same row and in the adjacent columns. Since the gray level values of the first pixel unit 5*a* and the second pixel unit 5*b* are derived from the same gray level value B, the difference is large and incurs the difference of the resolution in the horizontal direction in such layout. While the BL is extremely low, it would cause the loss of the resolution. Besides, in such layout, there is a whole row of the first pixel units 5*a* for receiving the higher gray level value BH and a whole row of the second pixel units 5*b* for receiving the lower gray level value BL. This would cause further the resolution loss.

For solving the issues mentioned above, this invention provides several embodiments of layout of the first pixel unit 5*a* and the second pixel unit 5*b:*

Figure 5:
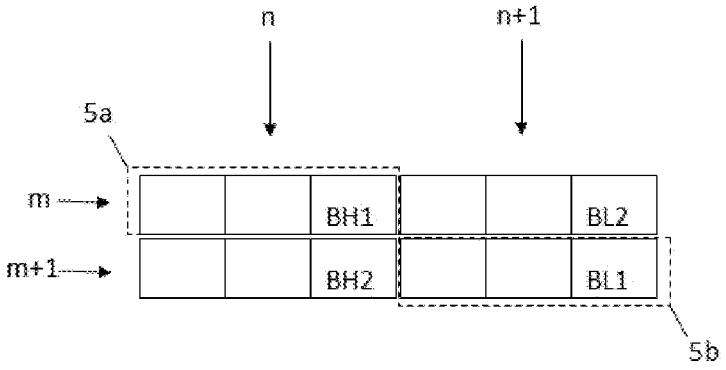
FIG. 5 is a schematic diagram to illustrate one of the dividing methods of the display unit in the present invention.

(1) the first pixel unit 5*a* and the second pixel unit 5*b* are disposed in the pixel units in the adjacent rows and columns. Specifically, with reference to FIG. 5, the first pixel unit 5*a* is the pixel unit in the m-th row and the n-th column, the second pixel unit 5*b* is the pixel unit in the (m+1)-th row and the (n+1)-th column, and the first pixel unit 5*a* and the second pixel unit 5*b* are formed a display unit. The other two pixel units in the (m+1)-th row and n-th column and in the m-th row and (n+1)-th column are formed another display unit. While the gray level value to the blue sub-pixel of the pixel unit in the m-th row and n-th column is BH1, the gray level value to the blue sub-pixel of the pixel unit in the (m+1)-th row and (n+1)-th column is BL1. In another display unit, the gray level value to the blue sub-pixel of the pixel unit in the (m+1)-th row and n-th column is BH2 and the gray level value to the blue sub-pixel of the pixel unit in the m-th row and (n+1)-th column is BL2, wherein m=1, 3, 5 . . . , M and n=1, 3, 5 . . . , N.

According the aforementioned layout of the first pixel unit 5*a* and the second pixel unit 5*b*, the higher gray level value BH and the lower gray level value BL derived from the same gray level value B are inputted to two of the blue sub-pixels in the adjacent pixels which belongs to different rows to reduce the resolution loss in the horizontal directions. Even BH1 and BL2 are inputted to the adjacent two pixel units in the same rows, the difference would not be large since BH1 and BL2 are derived from different gray level value B.

Figure 6:
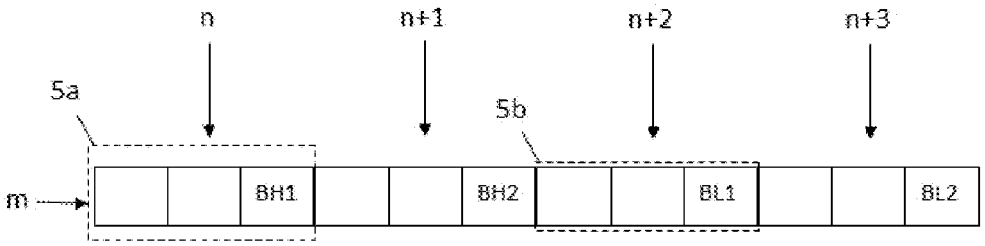
FIG. 6 is a schematic diagram to illustrate another of the dividing methods of the display unit in the present invention.

(2) the first pixel unit 5*a* and the second pixel unit 5*b* are disposed in the same row and in different columns which is spaced by another. Specifically, with reference to FIG. 6, the first pixel unit is the pixel unit in the m-th row and the n-th column, and the second pixel unit 5*b* is the pixel unit in the m-th row and the (n+2)-th pixel unit. The aforementioned first pixel unit 5*a* and the second pixel unit 5*b* are formed a display unit. The pixel unit in the m-th row and the (n+1)-th column, and the pixel unit in the m-th row and the (n+3)-th column are formed another display unit. While the gray level value to the blue sub-pixel of the pixel unit in the m-th row and n-th column is BH1, the gray level value to the blue sub-pixel of the pixel unit in the m-th row and (n+2)-th column is BL1. In another display unit, the gray level value to the blue sub-pixel of the pixel unit in the m-th row and (n+1)-th column is BH2 and the gray level value to the blue sub-pixel of the pixel unit in the m-th row and (n+3)-th column is BL2, wherein m=1, 2, 3 . . . , M and n=1, 4, 9 . . . , N.

According the aforementioned layout of the first pixel unit 5*a* and the second pixel unit 5*b*, the higher gray level value BH and the lower gray level value BL (BH1/BL1 and BH2/BL2) derived from the same gray level value B are inputted to two of the blue sub-pixels in the adjacent pixels which belongs to different rows to reduce the resolution loss in the horizontal directions.

Figure 7:
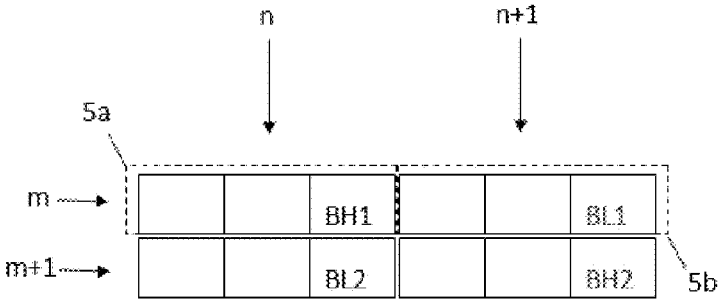
FIG. 7 is a schematic diagram to illustrate another of the dividing methods of the display unit in the present invention.

(3) the first pixel unit 5*a* and the second pixel unit 5*b* are disposed in the same row and in adjacent columns respectively. For the pixel unit which receives the lower gray level value BL, there is another pixel unit receiving higher gray level value BH in the same column and in the adjacent row. For the pixel unit which receives the higher gray level value BH, there is another pixel unit receiving lower gray level value BL in the same column and in the adjacent row. Specifically, with reference to FIG. 7, the first pixel unit 5*a* is the pixel unit in the m-th row and the n-th column, and the second pixel unit 5*b* is the pixel unit in the m-th row and the (n+1)-th column. The aforementioned first pixel unit 5*a* and the second pixel unit 5*b* are formed a display unit. The pixel unit in the (m+1)-th row and the n-th column, and the pixel unit in the (m+1)-th row and the (n+1)-th column are formed another display unit. While the gray level value to the blue sub-pixel of the pixel unit in the m-th row and n-th column is BH1, the gray level value to the blue sub-pixel of the pixel unit in the m-th row and (n+1)-th column is BL1. In another display unit, the gray level value to the blue sub-pixel of the pixel unit in the (m+1)-th row and n-th column is BL2 and the gray level value to the blue sub-pixel of the pixel unit in the (m+1)-th row and (n+1)-th column is BH2, wherein m=1, 2, 3 . . . , M and n=1, 3, 5 . . . , N.

According the aforementioned layout of the first pixel unit 5*a* and the second pixel unit 5*b*, the higher gray level value BH and the lower gray level value BL (BH1/BL1 and BH2/BL2) derived from the same gray level value B are inputted to two of the blue sub-pixels in the adjacent pixels which belongs to the same row. However, in the two adjacent rows, the higher gray level value BH1 and the lower gray level value BL2 are complementary and the lower gray level value BL1 and the higher gray level value BH2 are complementary. Therefore, in general, the higher gray level value BH and lower gray level value BL are spaced by each other in the horizontal and vertical directions to reduce the resolution loss.

Figure 8:
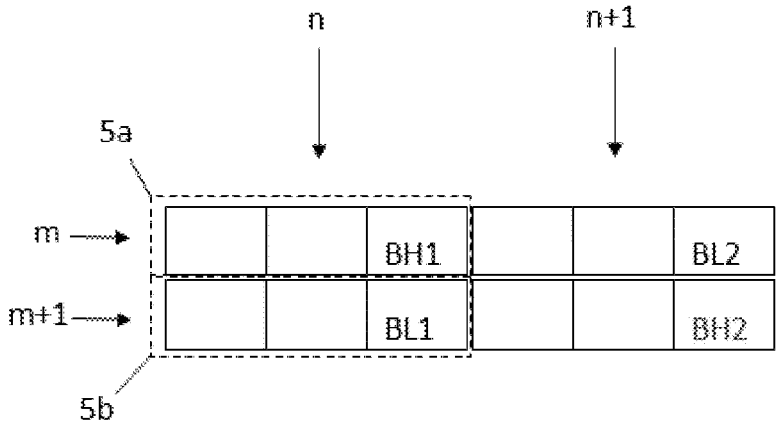
FIG. 8 is a schematic diagram to illustrate another of the dividing methods of the display unit in the present invention.

(4) The first pixel unit 5*a* and the second pixel unit 5*b* are disposed in the same column and in adjacent rows respectively. For the pixel unit which receives the lower gray level value BL, there is another pixel unit receiving higher gray level value BH in the same row and in the adjacent columns. Specifically, with reference to FIG. 8, the first pixel unit 5*a* is the pixel unit in the m-th row and the n-th column, and the second pixel unit 5*b* is the pixel unit in the (m+1)-th row and the n-th pixel unit. The aforementioned first pixel unit 5*a* and the second pixel unit 5*b* are formed a display unit. The pixel unit in the m-th row and the (n+1)-th column, and the pixel unit in the (m+1)-th row and the (n+1)-th column are formed another display unit. While the gray level value to the blue sub-pixel of the pixel unit in the m-th row and n-th column is BH1, the gray level value to the blue sub-pixel of the pixel unit in the (m+1)-th row and n-th column is BL1. In another display unit, the gray level value to the blue sub-pixel of the pixel unit in the m-th row and (n+1)-th column is BL2 and the gray level value to the blue sub-pixel of the pixel unit in the (m+1)-th row and (n+1)-th column is BH2, wherein m=1, 2, 3 . . . , M and n=1, 3, 5 . . . , N.

According the aforementioned layout of the first pixel unit 5*a* and the second pixel unit 5*b*, the higher gray level value BH and the lower gray level value BL (BH1/BL1 and BH2/BL2) derived from the same gray level value B are inputted to two of the blue sub-pixels in the adjacent pixels which belongs to the different rows. (For human eyes, there is no resolution loss while the gray level value difference is large in the same column and the two adjacent rows.) Therefore, in general, the higher gray level value BH and lower gray level value BL are spaced by each other in the horizontal and vertical directions to reduce the resolution loss.

The liquid crystal panel and the driving method mention above comprises dividing the liquid crystal panel into multiple display units, wherein each display unit comprises two of the pixel units, and providing a gray level value, B, to the blue sub-pixels of each of the display units with a higher gray level value, BH, and a lower gray level value, BL, to the blue sub-pixels respectively to achieve the effect of the conventional 2D1G display panel to lower the color shift issue at a perspective viewing angle. Meanwhile, the aperture rate would not be reduced to ensure the quality of the display panel. This invention also discloses the various layout design of the two pixel units in each display unit to reduce the resolution loss in the horizontal direction.

The aforementioned descriptions merely represent the preferred embodiments of instant disclosure, without any intention to limit the scope of the instant disclosure which is fully described only within the following claims. Various equivalent changes, alterations or modifications based on the claims of the instant disclosure are all, consequently, viewed as being embraces by the scope of the instant disclosure.

What is claimed is:

1. A method for driving a liquid crystal panel, comprising:

providing a liquid crystal panel with a plurality of pixel units in a matrix with M rows and N columns, wherein each of the pixel unit has at least a blue sub-pixel;

dividing the liquid crystal panel into multiple display units including a first display unit and a second display unit different from each other, wherein each display unit comprises two of the pixel units, the first display unit comprises a first pixel unit and a second pixel unit and the second display unit comprises a third pixel unit and a fourth pixel unit;

providing a gray level value, B, to the blue sub-pixels of each of the display units with a higher gray level value, BH, and a lower gray level value, BL, to the blue sub-pixels respectively, wherein the combination of BH and BL results the blue sub-pixels in the display unit to approach a predetermined Gamma Curve, and y=1.8~2.4 at a perspective viewing angle, the first pixel unit receives the higher gray level value provided to the first display unit, the second pixel unit receives the lower gray level value provided to the first display unit, the third pixel unit receives the higher gray level value provided to the second display unit and the fourth pixel unit receives the lower gray level value provided to the second display unit;

wherein the pixel units in the display unit are located in the same column and in different rows which are adjacent to each other, the first pixel unit and the fourth pixel unit are located in same row and in different columns adjacent to each other, and the second pixel unit and the third pixel unit are located in same row and in different columns adjacent to each other;

or the pixel units in the display unit are located in the same row and in different columns which are adjacent to each other, the first pixel unit and the fourth pixel unit are located in same column and in different rows adjacent to each other, and the second pixel unit and the third pixel unit are located in same column and in different rows adjacent to each other;

wherein the step of providing a gray level value, B, to the blue sub-pixels of each of the display units with a higher gray level value, BH, and a lower gray level value, BL further comprising:

S101, acquiring a relationship between the gray level value $B_0$ of the blue sub-pixel at a front viewing angle $\alpha$ and the actual brightness $Lv\alpha B_0$ in the curve $B_0$–$Lv\alpha B_0$;

S102, acquiring a relationship between the gray level value $B_0$ of the blue sub-pixel at a perspective viewing angle $\beta$ and the actual brightness $Lv\beta B_0$ in the curve $B_0$–$Lv\beta B_0$;

S103, acquiring the relation curve B–$Lv\alpha B$ and B–$Lv\beta B$ under the gray level value B and a theoretical brightness LvB at the front viewing angle $\alpha$ and the perspective viewing angle $\beta$ in accordance with the equation $(B/255)^{\gamma}=Lv\alpha B/Lv\alpha(255)$ and $(B/255)^{\gamma}=Lv\beta B/Lv\beta(255)$, wherein the $Lv\alpha(255)$ and $Lv\beta(255)$ are looked up from the relation curves $B_0$–$Lv\alpha B_0$ and $B_0$–$Lv\beta B_0$;

S104, BH and BL of the gray level value B to the blue sub pixels in the display unit are in accordance with the following equations:

$$\Delta 1=Lv\alpha B+Lv\alpha B-Lv\alpha(BH)-Lv\alpha(BL);$$

$$\Delta 2=Lv\beta B+Lv\beta B-Lv\beta(BH)-Lv\beta(BL);$$

$$y=\Delta 1^2+\Delta 2^2;$$

wherein y is the minimum, LvαB and LvβB are looked up from curves B–LvαB and B–LvβB, Lvα(BH) and Lvα(BL) are looked up from $B_0$–Lv$\alpha B_0$, and Lvβ(BL) are looked up from $B_0$–Lv$\beta B_0$; and S105, resetting a look up table (LUT) for each of the gray level value B of the blue sub-pixels in the display unit to acquire a combination of BH and BL in accordance with S104.

2. The driving method according to claim 1, wherein the front viewing angle α is 0° and the perspective viewing angle β is 30~80°.

3. The driving method according to claim 1, wherein the front viewing angle α is 0° and the perspective viewing angle β is 60°.

4. The driving method according to claim 1, wherein the pixel unit further comprises a red sub-pixel and a green-sub pixel, and the data signals of the red sub-pixel and the green sub-pixel is constant while resetting the data line signal of the blue sub-pixel.

5. The driving method according to claim 1, wherein the predetermined Gamma curve is γ=2.2.

6. A liquid display panel comprising a gate controller, a source controller, and an active area having a plurality of pixel units in a matrix with M rows and N columns and at least one blue sub-pixel in each pixel unit, wherein the active area is divided into a plurality of display units including a first display unit and a second display unit different from each other, each of the display unit comprises two pixel units, the first display unit comprises a first pixel unit and a second pixel unit and the second display unit comprises a third pixel unit and a fourth pixel unit, wherein the gate controller provides a scan signal to the pixel unit, wherein the source controller provides a data signal to the pixel unit, wherein a gray level value, B, is provided to the blue sub-pixels of each of the display units with a higher gray level value, BH, and a lower gray level value, BL, to each of the blue sub-pixels respectively, and the combination of BH and BL results the blue sub-pixels in the display unit to approach a predetermined Gamma Curve, and y=1.8~2.4 at a perspective viewing angle the first pixel unit receives the higher gray level value provided to the first display unit, the second pixel unit receives the lower gray level value provided to the first display unit, the third pixel unit receives the higher gray level value provided to the second display unit and the fourth pixel unit receives the lower gray level value provided to the second display unit;

wherein the pixel units in the display unit are located in the same column and in different rows which are adjacent to each other the first pixel unit and the fourth pixel unit are located in same row and in different columns adjacent to each other, and the second pixel unit and the third pixel unit are located in same row and in different columns adjacent to each other; or the pixel units in the display unit are located in the same row and in different columns which are adjacent to each other, the first pixel unit and the fourth pixel unit are located in same column and in different rows adjacent to each other, and the second pixel unit and the third pixel unit are located in same column and in different rows adjacent to each other;

wherein the step of providing a gray level value, B, to the blue sub-pixels of each of the display units with a higher gray level value, BH, and a lower gray level value, BL further comprising:

S101, acquiring a relationship between the gray level value $B_0$ of the blue sub-pixel at a front viewing angle α and the actual brightness Lv$\alpha B_0$ in the curve $B_0$–Lv$\alpha B_0$;

S102, acquiring a relationship between the gray level value $B_0$ of the blue sub-pixel at a perspective viewing angle β and the actual brightness Lv$\beta B_0$ in the curve $B_0$–Lv$\beta B_0$;

S103, acquiring the relation curve B–LvαB and B–LvβB under the gray level value B and a theoretical brightness LvB at the front viewing angle α and the perspective viewing angle β in accordance with the equation $(B/255)^{\gamma}$=LvαB/Lvα(255) and $(B/255)^{\gamma}$=LvβB/Lvβ(255), wherein the Lvα(255) and Lvβ(255) are looked up from the relation curves $B_0$–Lv$\alpha B_0$ and $B_0$–Lv$\beta B_0$;

S104, BH and BL of the gray level value B to the blue sub pixels in the display unit are in accordance with the following equations:

$$\Delta 1 = Lv\alpha B + Lv\alpha B - Lv\alpha(BH) - Lv\alpha(BL);$$

$$\Delta 2 = Lv\beta B + Lv\beta B - Lv\beta(BH) - Lv\beta(BL);$$

$$y = \Delta 1^2 + \Delta 2^2;$$

wherein y is the minimum, LvαB and LvβB are looked up from curves B–LvαB and B–LvβB, Lvα(BH) and Lvα(BL) are looked up from $B_0$–Lv$\alpha B_0$, and Lvβ(BH) and Lvβ(BL) are looked up from $B_0$–Lv$\beta B_0$; and S105, resetting a look up table (LUT) for each of the gray level value B of the blue sub-pixels in the display unit to acquire a combination of BH and BL in accordance with S104.

7. The liquid display panel according to claim 6, wherein the front viewing angle α is 0° and the perspective viewing angle β is 30~80°.

8. The liquid display panel according to claim 6, wherein the front viewing angle α is 0° and the perspective viewing angle β is 60°.

9. The liquid display panel according to claim 6, wherein the pixel unit further comprises a red sub-pixel and a green-sub pixel, and the data signals of the red sub-pixel and the green sub-pixel is constant while resetting the data line signal of the blue sub-pixel.

10. The liquid display panel according to claim 6, wherein the predetermined Gamma curve is γ=2.2.

* * * * *